US012377455B2

(12) United States Patent
Joshi et al.

(10) Patent No.: US 12,377,455 B2
(45) Date of Patent: Aug. 5, 2025

(54) FUNCTIONALLY GRADED COATINGS AND CLADDINGS

(71) Applicant: Battelle Memorial Institute, Richland, WA (US)

(72) Inventors: Vineet V. Joshi, Richland, WA (US); Glenn J. Grant, Benton City, WA (US); Curt A. Lavender, Richland, WA (US); Scott A. Whalen, West Richland, WA (US); Saumyadeep Jana, Kennewick, WA (US); David Catalini, Hyattsville, MD (US); Jens T. Darsell, West Richland, WA (US)

(73) Assignee: Battelle Memorial Institute, Richland, WA (US)

( * ) Notice: Subject to any disclaimer, the term of this patent is extended or adjusted under 35 U.S.C. 154(b) by 0 days.

(21) Appl. No.: 17/984,144

(22) Filed: Nov. 9, 2022

(65) Prior Publication Data

US 2023/0088412 A1 Mar. 23, 2023

Related U.S. Application Data

(63) Continuation of application No. 16/916,548, filed on Jun. 30, 2020, now Pat. No. 11,517,952, which is a (Continued)

(51) Int. Cl.
*B21C 23/00* (2006.01)
*B21C 23/04* (2006.01)
(Continued)

(52) U.S. Cl.
CPC ..... *B21C 23/002* (2013.01); *B21C 23/04* (2013.01); *B21C 23/217* (2013.01);
(Continued)

(58) Field of Classification Search
CPC ..... B21C 23/001; B21C 23/002; B21C 23/04; B21C 23/08; B21C 23/085; B21C 23/18;
(Continued)

(56) References Cited

U.S. PATENT DOCUMENTS 3,432,369 A 3/1969 Naastepad
3,640,657 A 2/1972 Rowe et al.
(Continued)

FOREIGN PATENT DOCUMENTS

CN 106140847 A 11/2016
CN 107282671 A 10/2017
(Continued)

OTHER PUBLICATIONS

"U.S. Appl. No. 17/033,854, Final Office Action mailed Jun. 7, 2023", 11 pgs.
(Continued)

*Primary Examiner* — Jeffrey T Carley
*Assistant Examiner* — Joshua D Anderson
(74) *Attorney, Agent, or Firm* — Schwegman, Lundberg & Woessner, P.A.

(57) ABSTRACT

A shear assisted extrusion process for producing cladded materials wherein a cladding material and a material to be cladded are placed in sequence with the cladded material positioned to contact a rotating scroll face first and the material to be cladded second. The two materials are fed through a shear assisted extrusion device at a preselected feed rate and impacted by a rotating scroll face to generate a cladded extrusion product. This process allows for increased through wall strength and decreases the brittleness in formed structures as compared to the prior art.

20 Claims, 7 Drawing Sheets

Related U.S. Application Data continuation of application No. 15/898,515, filed on Feb. 17, 2018, now Pat. No. 10,695,811, which is a continuation-in-part of application No. 15/351,201, filed on Nov. 14, 2016, now Pat. No. 10,189,063, which is a continuation-in-part of application No. 14/222,468, filed on Mar. 21, 2014, now abandoned.

(60) Provisional application No. 62/460,227, filed on Feb. 17, 2017, provisional application No. 62/313,500, filed on Mar. 25, 2016, provisional application No. 61/804,560, filed on Mar. 22, 2013.

(51) Int. Cl.

| | |
|---|---|
| ***B21C 23/21*** | (2006.01) |
| ***B21C 23/22*** | (2006.01) |
| ***B21C 25/02*** | (2006.01) |
| ***B21C 27/02*** | (2006.01) |
| ***B21C 29/00*** | (2006.01) |

(52) U.S. Cl.

CPC ..... *B21C 23/218* (2013.01); *B21C 23/22* (2013.01); *B21C 25/02* (2013.01); *B21C 27/02* (2013.01); *B21C 29/003* (2013.01)

(58) Field of Classification Search

CPC ..... B21C 23/183; B21C 23/186; B21C 23/20; B21C 23/205; B21C 23/21; B21C 23/212; B21C 23/217; B21C 23/218; B21C 23/22; B21C 25/02; B21C 27/021; B21C 29/003; B21C 29/04; B21C 33/004; B21C 33/006; B22F 3/20

See application file for complete search history.

(56) References Cited

U.S. PATENT DOCUMENTS

| | | | |
|---|---|---|---|
| 3,661,726 | A | 5/1972 | Denes |
| 3,684,593 | A | 8/1972 | Benz et al. |
| 3,884,062 | A | 5/1975 | Green |
| 3,892,603 | A | 7/1975 | Reid |
| 3,933,536 | A | 1/1976 | Doser et al. |
| 3,977,918 | A | 8/1976 | Paladino et al. |
| 3,989,548 | A | 11/1976 | Morris |
| 4,287,749 | A | 9/1981 | Bachrach et al. |
| 4,300,378 | A | 11/1981 | Thiruvarudchelvan |
| 4,431,467 | A | 2/1984 | Staley et al. |
| 4,585,473 | A | 4/1986 | Narasimhan et al. |
| 4,778,542 | A | 10/1988 | Clemens |
| 4,801,340 | A | 1/1989 | Inoue et al. |
| 4,808,224 | A | 2/1989 | Anderson et al. |
| 4,892,596 | A | 1/1990 | Chatterjee |
| 4,985,085 | A | 1/1991 | Chatterjee |
| 5,026,438 | A | 6/1991 | Young et al. |
| 5,089,060 | A | 2/1992 | Bradley et al. |
| 5,226,989 | A | 7/1993 | Sukonnik |
| 5,242,508 | A | 9/1993 | McCallum et al. |
| 5,262,123 | A | 11/1993 | Thomas et al. |
| 5,283,130 | A | 2/1994 | Bradley et al. |
| 5,437,545 | A | 8/1995 | Hirai |
| 5,461,898 | A | 10/1995 | Lessen |
| 5,470,401 | A | 11/1995 | McCallum et al. |
| 5,492,264 | A | 2/1996 | Wadleigh |
| 5,737,959 | A | 4/1998 | Korbel et al. |
| 5,739,498 | A | 4/1998 | Sunamoto et al. |
| 5,964,117 | A | 10/1999 | Holroyd et al. |
| 5,988,484 | A | 11/1999 | Osborn et al. |
| 6,022,424 | A | 2/2000 | Sellers et al. |
| 6,036,467 | A | 3/2000 | Jameson |
| 6,638,462 | B2 | 10/2003 | Davidson et al. |
| 6,843,405 | B2 | 1/2005 | Okamoto et al. |
| 6,940,379 | B2 | 9/2005 | Creighton |
| 7,096,705 | B2 | 8/2006 | Segal |
| 7,314,670 | B2 | 1/2008 | Bartsch et al. |
| 7,322,508 | B2 | 1/2008 | Chang |
| 7,954,692 | B2 | 6/2011 | Fukuda |
| 8,016,179 | B2 | 9/2011 | Burford |
| 8,240,540 | B2 | 8/2012 | Tanaka et al. |
| 8,313,692 | B2 | 11/2012 | Somekawa et al. |
| 8,695,868 | B2 | 4/2014 | Messer et al. |
| 10,189,063 | B2 | 1/2019 | Lavender et al. |
| 10,369,748 | B2 | 8/2019 | Whalen et al. |
| 10,695,811 | B2 | 6/2020 | Joshi et al. |
| 10,987,754 | B1 | 4/2021 | Eller et al. |
| 11,045,851 | B2 | 6/2021 | Joshi et al. |
| 2002/0029601 | A1 | 3/2002 | Kwok |
| 2004/0057782 | A1 | 3/2004 | Okamoto et al. |
| 2004/0238501 | A1 | 12/2004 | Kawazoe et al. |
| 2004/0265503 | A1 | 12/2004 | Clayton et al. |
| 2005/0081594 | A1 | 4/2005 | Segal |
| 2006/0005898 | A1 | 1/2006 | Lui et al. |
| 2006/0027628 | A1 | 2/2006 | Sutherlin et al. |
| 2008/0029581 | A1 | 2/2008 | Kumagai et al. |
| 2008/0048005 | A1 | 2/2008 | Forrest et al. |
| 2008/0202653 | A1 | 8/2008 | Ignberg |
| 2008/0251571 | A1 | 10/2008 | Burford |
| 2009/0072007 | A1 | 3/2009 | Nagano |
| 2009/0269605 | A1 | 10/2009 | Warke et al. |
| 2009/0291322 | A1 | 11/2009 | Watanabe et al. |
| 2010/0059151 | A1 | 3/2010 | Iwamura et al. |
| 2010/0089976 | A1 | 4/2010 | Szymanski et al. |
| 2010/0132430 | A1 | 6/2010 | Tsai et al. |
| 2011/0104515 | A1 | 5/2011 | Kou et al. |
| 2011/0132970 | A1 | 6/2011 | Nakagawa et al. |
| 2011/0309131 | A1 | 12/2011 | Hovanski et al. |
| 2012/0006086 | A1 | 1/2012 | Manchiraju et al. |
| 2012/0052322 | A1 | 3/2012 | Hatakeyama et al. |
| 2012/0168045 | A1 | 7/2012 | Ihara et al. |
| 2012/0223451 | A1 | 9/2012 | Hulseman et al. |
| 2012/0258332 | A1 | 10/2012 | Hatakeyama et al. |
| 2013/0075452 | A1 | 3/2013 | Burford |
| 2013/0266467 | A1* | 10/2013 | Manchiraju ..... B21C 23/002 419/4 |
| 2014/0000332 | A1 | 1/2014 | Wilson et al. |
| 2014/0002220 | A1 | 1/2014 | Johnson et al. |
| 2014/0076957 | A1 | 3/2014 | Sayama et al. |
| 2014/0102159 | A1 | 4/2014 | Denison |
| 2014/0102161 | A1 | 4/2014 | Stewart |
| 2014/0248508 | A1 | 9/2014 | Ohhama et al. |
| 2014/0260489 | A1 | 9/2014 | Funk et al. |
| 2014/0283574 | A1 | 9/2014 | Lavender et al. |
| 2014/0291886 | A1 | 10/2014 | Mark et al. |
| 2014/0328710 | A1 | 11/2014 | Cui et al. |
| 2015/0075242 | A1 | 3/2015 | Eller et al. |
| 2015/0115019 | A1 | 4/2015 | Pascal et al. |
| 2015/0360317 | A1 | 12/2015 | Kalvala et al. |
| 2016/0008918 | A1 | 1/2016 | Burford |
| 2016/0151817 | A1 | 6/2016 | Nayfeh et al. |
| 2016/0151818 | A1 | 6/2016 | Shao |
| 2016/0167353 | A1 | 6/2016 | Fan et al. |
| 2016/0175981 | A1 | 6/2016 | Kandasamy |
| 2016/0175982 | A1 | 6/2016 | Kandasamy et al. |
| 2016/0184922 | A1 | 6/2016 | Kikyo |
| 2016/0228932 | A1 | 8/2016 | Hayashi et al. |
| 2016/0354860 | A1 | 12/2016 | Boettcher et al. |
| 2017/0008121 | A1 | 1/2017 | Li |
| 2017/0056947 | A1 | 3/2017 | Lavender et al. |
| 2017/0136686 | A1 | 5/2017 | Ueno et al. |
| 2017/0163135 | A1 | 6/2017 | Emberton et al. |
| 2017/0182587 | A1 | 6/2017 | Tokoro et al. |
| 2017/0216961 | A1 | 8/2017 | Utter et al. |
| 2017/0225265 | A1 | 8/2017 | Ito et al. |
| 2017/0304933 | A1 | 10/2017 | Miles et al. |
| 2017/0355003 | A1 | 12/2017 | TenHouten et al. |
| 2018/0036840 | A1 | 2/2018 | Hu et al. |
| 2018/0043467 | A1 | 2/2018 | Huysmans |
| 2018/0050419 | A1 | 2/2018 | Das et al. |
| 2018/0073532 | A1 | 3/2018 | Whalen et al. |
| 2018/0311713 | A1 | 11/2018 | Joshi et al. |
| 2018/0354231 | A1 | 12/2018 | Iwase |
| 2018/0369889 | A1 | 12/2018 | Zhang et al. |
| 2019/0267153 | A1 | 8/2019 | Kappagantula et al. |

(56) References Cited

U.S. PATENT DOCUMENTS

| | | | |
|---|---|---|---|
| 2019/0275608 | A1 | 9/2019 | Das et al. |
| 2021/0053100 | A1 | 2/2021 | Whalen et al. |
| 2021/0086291 | A1 | 3/2021 | Okada et al. |
| 2021/0205918 | A1 | 7/2021 | Fujii et al. |
| 2021/0252632 | A1 | 8/2021 | Eller et al. |
| 2023/0081786 | A1 | 3/2023 | Joshi et al. |
| 2023/0150022 | A1 | 5/2023 | Whalen et al. |
| 2023/0234115 | A1 | 7/2023 | Kappagantula et al. |

FOREIGN PATENT DOCUMENTS

| | | | |
|---|---|---|---|
| CN | 105925846 | B | 2/2018 |
| CN | 109295332 | B | 4/2020 |
| CN | 112512710 | B | 10/2023 |
| EP | 2990178 | | 8/2014 |
| EP | 2777837 | A1 | 9/2014 |
| GB | 1258141 | | 12/1971 |
| JP | 2002361320 | A | 12/2002 |
| JP | 2003-275876 | | 9/2003 |
| JP | 2004174563 | | 6/2004 |
| JP | 2007-222925 | | 9/2007 |
| JP | 2009090359 | A | 4/2009 |
| JP | 2019115909 | A | 7/2019 |
| KR | 101316989 | B1 | 10/2013 |
| WO | 2019040730 | | 2/2019 |
| WO | 2020010331 | | 1/2020 |
| WO | 2020053168 | | 3/2020 |
| WO | WO-2021062415 | A1 | 4/2021 |
| WO | 2022043532 | | 3/2022 |
| WO | 2022056358 | | 3/2022 |
| WO | 2023015228 | | 2/2023 |
| WO | WO-2023177693 | A1 | 9/2023 |

OTHER PUBLICATIONS

"U.S. Appl. No. 17/035,597, Final Office Action mailed May 10, 2023", 13 pgs.
"U.S. Appl. No. 17/473,178, Non Final Office Action mailed Feb. 8, 2023", 22 pgs.
"U.S. Appl. No. 17/826,054, Preliminary Amendment filed Jul. 13, 2023", 9 pgs.
"International Application Serial No. PCT US2023 015228, International Search Report mailed Jun. 15, 2023", 5 pgs.
"International Application Serial No. PCT US2023 015228, Written Opinion mailed Jun. 15, 2023", 6 pgs.
"International Application Serial No. PCT US2021 050022, International Preliminary Report on Patentability mailed Dec. 1, 2022", 18 pgs.
"U.S. Appl. No. 17/033,854, Response filed Aug. 7, 2023 to Final Office Action mailed Jun. 7, 2023", 9 pgs.
"U.S. Appl. No. 17/033,854, Advisory Action mailed Aug. 16, 2023", 4 pgs.
"U.S. Appl. No. 17/035,597, Non Final Office Action mailed Aug. 28, 2023", 10 pgs.
"U.S. Appl. No. 17/242,166, Final Office Action mailed Aug. 30, 2023", 7 pgs.
"European Application Serial No. 19745460.6, Response filed Sep. 18, 2023 to Communication Pursuant to Article 94(3) EPC mailed May 10, 2023", 9 pgs.
"European Application Serial No. 19745460.6, Communication Pursuant to Article 94(3) EPC mailed May 10, 2023", 6 pgs.
"CN 201980045070X Office Action mailed Sep. 6, 2022", with English translation, 13 pages.
"CN 201980045070X Response mailed Apr. 11, 2023 to Office Action Sep. 6, 2022", with English claims, 8 pages.
U.S. Appl. No. 14/222,468, filed Mar. 21, 2014, System and Process for Formation of Extrusion Structures.
U.S. Appl. No. 15/351,201 U.S. Pat. No. 10,189,063, filed Nov. 14, 2016, System and Process for Formation of Extrusion Products.
U.S. Appl. No. 62/460,227, filed Feb. 17, 2017, Functionally Graded Coatings and Claddings.
U.S. Appl. No. 15/898,515 U.S. Pat. No. 10,695,811, filed Feb. 17, 2018, Functionally Graded Coatings and Claddings.
U.S. Appl. No. 16/916,548 U.S. Pat. No. 11,517,952, filed Jun. 30, 2020, Shear Assisted Extrusion Process.
U.S. Appl. No. 16/028,173 U.S. Pat. No. 11,045,851, filed Jul. 5, 2018, Method for Forming Hollow Profile Non-Circular Extrusions Using Shear Assisted Processing and Extrusion (Shape).
U.S. Appl. No. 17/175,464 U.S. Pat. No. 11,534,811, filed Feb. 12, 2021, Method For Forming Hollow Profile Non-Circular Extrusions Using Shear Assisted Processing and Extrusion (Shape).
U.S. Appl. No. 16/562,314 U.S. Pat. No. 11,383,280, filed Sep. 5, 2019, Devices and Methods For Performing Shear-Assisted Extrusion, Extrusion Feedstocks, Extrusion Processes, and Methods For Preparing Metal Sheets.
U.S. Appl. No. 17/985,611, filed Nov. 11, 2022, Method For Forming Hollow Profile Non-Circular Extrusions Using Shear Assisted Processing and Extrusion (Shape).
U.S. Appl. No. 17/826,054, filed May 26, 2022, Devices and Methods For Performing Shear-Assisted Extrusion, Extrusion Feedstocks, Extrusion Processes, And Methods For Preparing Metal Sheets.
U.S. Appl. No. 17/665,433, U.S. Pat. No. 11,684,959, filed Feb. 4, 2022, Extrusion Processes For Forming Extrusions of a Desired Composition From a Feedstock.
U.S. Appl. No. 17/033,854, filed Sep. 27, 2020, Devices and Methods For Performing Shear-Assisted Extrusion and Extrusion Processes.
U.S. Appl. No. 17/874,140, filed Jul. 26, 2022, Devices and Methods For Performing Shear-Assisted Extrusion and Extrusion Processes.
U.S. Appl. No. 17/035,597, filed Sep. 28, 2020, Shape Processes, Feedstock Materials, Conductive Materials and/or Assemblies.
U.S. Appl. No. 17/242,166, filed Apr. 27, 2021, Devices and Methods For Performing Shear-Assisted Extrusion and Extrusion Processes.
U.S. Appl. No. 17/957,207, filed Sep. 30, 2022, Devices and Methods For Performing Shear-Assisted Extrusion and Extrusion Processes.
U.S. Appl. No. 17/473,178, filed Sep. 13, 2021, Devices and Methods For Performing Shear-Assisted Extrusion and Extrusion Processes.
U.S. Appl. No. 18/093,636, filed Jan. 5, 2023, Devices and Methods For Performing Shear-Assisted Extrusion and Extrusion Processes.
U.S. Appl. No. 18/121,563, filed Mar. 14, 2023, Extrusion Prcesses, Feedstock Materials, Conductive Materials and/or Assemblies.
WO PCT/US2023/015228 Search Rpt, Jun. 15, 2023, Battelle Memorial Institute.
WO PCT/US2023/015228 Written Opin, Jun. 15, 2023, Battelle Memorial Institute.
WO PCT/US22/43532 Search Rept, Jan. 12, 2023, Battelle Memorial Institute.
WO PCT/US22/43532 Written Opin, Jan. 12, 2023, Battelle Memorial Institute.
WO PCT/US2021/050022 IPRP, Dec. 1, 2022, Battelle Memorial Institute.
WO PCT/US2019/040730 IPRP, Jan. 5, 2021, Battelle Memorial Institute.
WO PCT/US2019/040730 SR, Oct. 21, 2019, Battelle Memorial Institute.
WO PCT/US2019/040730 WO, Oct. 21, 2019, Battelle Memorial Institute.
WO PCT/US2020/053168 IPRP, Apr. 7, 2022, Battelle Memorial Institute.
WO PCT/US2020/053168 Search Rpt, Feb. 8, 2021, Battelle Memorial Institute.
WO PCT/US2020/053168 Written Opin, Feb. 8, 2021, Battelle Memorial Institute.
WO PCT/US2021/050022 Search Rpt, Feb. 3, 2022, Battelle Memorial Institute.
WO PCT/US2021/050022 Written Opin, Feb. 3, 2022, Battelle Memorial Institute.

(56) References Cited

OTHER PUBLICATIONS

Abu-Farha, "A Preliminary Study on the Feasibility of Friction Stir Back Extrusion", Scripta Materials, 66, 2012, United States, 615-618.
Amancio-Filho et al., "Joining of Polymers and Polymer-Metal Hybrid Structures: Recent Developments and Trends", Polymer Engineering & Science, 2009, United States, pp. 1461-1476.
Bozzi et al., "Intermetallic Compounds in Al 6016/IF-Steel Friction Stir Spot Welds", Materials Science and Engineering, 2010, Netherlands, pp. 4505-4509.
Cole et al., "Lightweight materials for Automotive Applications", Materials Characterization, 35, 1995, United States, pp. 3-9.
Evans et al., "Friction Stir Extrusion: A new process for joining dissimilar materials", Manufacturing Letters, 5, 2015, United States, pp. 25-28.
Gann, J.A., "Magnesium Industry's Lightest Structural Metal", SAE Transactions, vol. 25-26, 1930-1931, United States, pp. 620-634, 641.
Hammond et al., "Equal-Channel Angular Extrusion of a Low-Density High-Entropy Alloy Produced by High-Energy Cryogenic Mechanical Alloying", JOM. vol. 66, No. 10, United States, 2014, pp. 2021-2029.
Kaiser et al., "Anisotropic Properties of Magnesium Sheet AZ31", Materials Science Forum, vols. 419-422, Switzerland, 2003, pp. 315-320.
Kuo et al., "Fabrication of High Performance Magnesium/Carbon-Fiber/PEEK/Laminated Composites", Materials Transactions, vol. 44, No. 8 (2003), Japan, pp. 1613-1619.
Leitao et al., "Aluminum-steel lap joining by multipass friction stir welding", Materials and Design, 106, 2016, United States, pp. 153-160.
Liu et al., "A Review of Dissimilar Welding Techniques for Magnesium Alloys to Aluminum Alloys", Materials, 7, 2014, United States, pp. 3735-3757.
Liu et al., "Microstructure and mechanical properties of equimolar FeCoCrNi high entropy alloy prepared via powder extrusion", Intermetallics 75 (2016) , United States, pp. 25-30.
Luo, Alan, "Magnesium: Current and Potential Automotive Applications", JOM, 54(2), 2002, United States, pp. 42-48.
Martinsen et al., "Joining of Dissimilar Materials", CIRP Annals - Manufacturing Technology, 2015, United States, 21 pages.
Nakamura et al., "Tool Temperature and Process Modeling of Friction Stir Welding", (2018) Modern Mechanical Engineering, 8, 78-94.
Office Action for U.S. Appl. No. 14/222,468, filed Mar. 21, 2014, First named inventor Curtis A. Lavender, Notification date Nov. 6, 2015, 10 pages.
Office Action for U.S. Appl. No. 14/222,468, filed Mar. 21, 2014, First named inventor Curtis A. Lavender, Notification date Apr. 1, 2016, 10 pages.
Office Action for U.S. Appl. No. 14/222,468, filed Mar. 21, 2014, First named inventor Curtis A. Lavender, Notification date May 20, 2016, 3 pages.
Office Action for U.S. Appl. No. 14/222,468, filed Mar. 21, 2014, First named inventor Curtis A. Lavender, Notification date Jan. 26, 2017, 9 pages.
Office Action for U.S. Appl. No. 14/268,220, filed May 2, 2014, First Named Inventor Jun Cui, Notification date Dec. 1, 2015, 7 pages.
Pickens, "Aluminum Powder Metallurgy Technology for High-Strength Applications", Journal of Materials Science 16 (1981) 1437-1457, United Kingdom, 21 pages.
Rodewald et al. "Top Nd—Fe—B Magnets with Greater Than 56 MGOe Energy Density and 9.8 kOe Coercivity", IEEE Transactions on Magnetics, vol. 38, No. 5, 2002, United States, pp. 2955-2957.
Saha, "Aluminum Extrusion Technology, Chapter 1, Fundamentals of Extrusion", The Materials Information Society, ASM International, 2000, United States, pp. 1-29.
Thomasnet.com, https:/www.thomasnet.com/articles/custom-manufacturing-fabricating/friction-stir-welding/ Feb. 10, 2011 (Year: 2011).
Trang et al., "Designing a Magnesium Alloy with High Strength and High Formability", Nature Communications, 2018, United Kingdom, 6 pages.
Whalen et al., "High Ductility Aluminum Alloy Made from Powder by Friction Extrusion", Materalia 6 (2019) 100260, Netherlands, 6 pages.
Whalen et al., U.S. Appl. No. 15/694,565, filed Sep. 1, 2017, titled "System and Process for Joining Dissimilar Materials and Solid-State Interocking Joint with Intermetallic Interface Formed Thereby", 69 pages.
Zhang et al., "Numerical Studies on Effect of Axial Pressure in Friction Stir Welding", (2007) Science and Technology of Welding and Joining, vol. 12, No. 3, United Kingdom, pp. 226-248.
"European Application Serial No. 21867741.7, Response to Communication Pursuant to Rules 161 and 162 EPC filed Oct. 16, 2023", 15 pgs.
"U.S. Appl. No. 17/473,178, Final Office Action mailed Oct. 20, 2023", 9 pgs.
"U.S. Appl. No. 17/473,178, Response filed Dec. 20, 2023 to Final Office Action mailed Oct. 20, 2023", 11 pgs.
"U.S. Appl. No. 17/473,178, Response filed Jul. 10, 2023 to Non Final Office Action mailed Feb. 8, 2023", 13 pgs.
"U.S. Appl. No. 18/093,636, Restriction Requirement mailed Dec. 20, 2023", 6 pgs.
"U.S. Appl. No. 17/473,178, Advisory Action mailed Jan. 3, 2024", 3 pgs.
"U.S. Appl. No. 17/473,178, Non Final Office Action mailed Jan. 3, 2024", 10 pgs.
"Chinese Application Serial No. 202311192831.9, Response filed Dec. 28, 2023 to Notification to Make Rectification issued Nov. 1, 2023", with English claims, 21 pages.
"European Application Serial No. 19745460.6, Summons to attend oral proceedings pursuant to Rule 115(1) EPC mailed Jan. 4, 2024", 6 pgs.
"Canadian Application Serial No. 3,105,375 Examiners Rule 86 2 Requisition mailed Dec. 28, 2023", 7 pgs.
"Chinese Application Serial No. 202180062766.0, Voluntary Amendment filed Nov. 13, 2023", with English claims, 91 pages.
"Canadian Application Serial No. 3,192,375, Voluntary Amendment filed Dec. 28, 2023", 59 pgs.
"U.S. Appl. No. 17/035,597, Response filed Feb. 28, 2024 to Non Final Office Action mailed Aug. 28, 2023", 10 pgs.
"U.S. Appl. No. 17/033,854, Non Final Office Action mailed Oct. 4, 2023", 11 pgs.
"U.S. Appl. No. 17/033,854, Response filed Mar. 7, 2024 to Non Final Office Action mailed Oct. 4, 2023", 10 pgs.
"U.S. Appl. No. 17/826,054, Non Final Office Action mailed Mar. 8, 2024", 13 pgs.
"U.S. Appl. No. 17/874,140, Non Final Office Action mailed Mar. 20, 2024", 10 pgs.
"U.S. Appl. No. 14/222,468, Non-Final Office Action mailed Nov. 6, 2015", 10 pgs.
"U.S. Appl. No. 17/033,854, Advisory Action mailed Jun. 5, 2024", 4 pgs.
"U.S. Appl. No. 17/033,854, Examiner Interview Summary mailed Jul. 30, 2024", 3 pgs.
"U.S. Appl. No. 17/033,854, Final Office Action mailed Mar. 28, 2024", 12 pgs.
"U.S. Appl. No. 17/033,854, Response filed May 28, 2024 to Final Office Action mailed Mar. 28, 2024", 13 pgs.
"U.S. Appl. No. 17/033,854, Response filed Aug. 23, 2024 to Advisory Action mailed Jun. 5, 2024", 17 pgs.
"U.S. Appl. No. 17/035,597, Examiner Interview Summary mailed Aug. 22, 2024", 3 pgs.
"U.S. Appl. No. 17/035,597, Final Office Action mailed Apr. 17, 2024", 23 pgs.
"U.S. Appl. No. 17/035,597, Non Final Office Action mailed Sep. 6, 2024", 19 pgs.
"U.S. Appl. No. 17/035,597, Response filed Aug. 19, 2024 to Final Office Action mailed Apr. 17, 2024", 17 pgs.

(56) References Cited

OTHER PUBLICATIONS

"U.S. Appl. No. 17/035,597, Response filed Sep. 11, 2023 to Non Final Office Action mailed Aug. 28, 2023", 61 pgs.
"U.S. Appl. No. 17/473,178, Final Office Action mailed Jun. 14, 2024", 21 pgs.
"U.S. Appl. No. 17/473,178, Non Final Office Action mailed Feb. 28, 2024", 19 pgs.
"U.S. Appl. No. 17/473,178, Response filed Apr. 11, 2024 to Non Final Office Action mailed Jan. 3, 2024", 8 pgs.
"U.S. Appl. No. 17/473,178, Response filed May 28, 2024 to Non Final Office Action mailed Feb. 28, 2024", 10 pgs.
"U.S. Appl. No. 17/826,054, Examiner Interview Summary mailed Jul. 30, 2024", 3 pgs.
"U.S. Appl. No. 17/826,054, Response filed Aug. 8, 2024 to Non Final Office Action mailed Mar. 8, 2024", 13 pgs.
"U.S. Appl. No. 17/957,207, Final Office Action mailed Jun. 12, 2024", 13 pgs.
"U.S. Appl. No. 17/985,611, Non Final Office Action mailed Mar. 27, 2024", 10 pgs.
"U.S. Appl. No. 18/093,636, Non Final Office Action mailed Jun. 14, 2024", 14 pgs.
"U.S. Appl. No. 18/093,636, Response filed Apr. 5, 2024 to Restriction Requirement mailed Dec. 20, 2023", 6 pgs.
"Canadian Application No. 3155420, Examiners Rule 862 Requisition Report Consolidated Correspondence Jul. 20, 2023", 5 pgs.
"Canadian Application No. 3155420, Examiners Rule mailed May 11, 2023", 4 pgs.
"Canadian Application Serial No. 3,105,375, Response filed Apr. 26, 2024 to Examiners Rule 86 2 Requisition mailed Dec. 28, 2023", 27 pgs.
"Canadian Application Serial No. 3,155,420, Examiners Rule 862 Requisition Report Apr. 18, 2024", 3 pgs.
"European Application Serial No. 19745460.6, Response filed Jun. 20, 2024 to Summons to attend oral proceedings pursuant to Rule 115(1) EPC mailed Jan. 4, 2024", 12 pgs.
"European Application Serial No. 20869757, Extended European Search Report mailed Sep. 19, 2023", 10 pgs.
"European Application Serial No. 20869757, Response filed Apr. 12, 2024 to Extended European Search Report mailed Sep. 19, 2023", 13 pgs.
"European Application Serial No. 20869757.3, Communication Pursuant to Article 94(3) EPC mailed Sep. 4, 2024", 6 pgs.
"European Application Serial No. 21867741.7, Extended European Search Report mailed Aug. 12, 2024", 8 pgs.
"International Application Serial No. PCT/US2019/040730, International Preliminary Report on Patentability mailed Jan. 5, 2021", 8 pgs.
"International Application Serial No. PCT/US2019/040730, International Search Report mailed Oct. 21, 2019", 4 pgs.
"International Application Serial No. PCT/US2019/040730, Written Opinion mailed Oct. 21, 2019", 7 pgs.
"International Application Serial No. PCT/US2020/05168 International Search Report mailed Feb. 8, 2021", 5 pgs.
"International Application Serial No. PCT/US2020/05168 Written Opinion mailed Feb. 8, 2021", 6 pgs.
"International Application Serial No. PCT/US2020/053168, International Preliminary Report on Patentability mailed Apr. 7, 2022", 8 pgs.
"International Application Serial No. PCT/US2021/050022, International Preliminary Report on Patentability mailed Dec. 1, 2022", 17 pgs.
"International Application Serial No. PCT/US2021/050022, International Search Report mailed Feb. 3, 2022", 5 pgs.
"International Application Serial No. PCT/US2021/050022, Written Opinion mailed Feb. 3, 2022", 6 pgs.
"U.S. Appl. No. 17/033,854, Notice of Allowance mailed Sep. 20, 2024", 16 pgs.
"U.S. Appl. No. 17/874,140, Response filed Sep. 16, 2024 to Non Final Office Action mailed Mar. 20, 2024", 15 pgs.
"U.S. Appl. No. 17/985,611, Response filed Sep. 17, 2024 to Non Final Office Action mailed Mar. 27, 2024", 12 pgs.
"Canadian Application Serial No. 3,155,420, Response filed Aug. 13, 2024 to Examiners Rule 862 Requisition Report Apr. 18, 2024", 10 pages.
"Application Serial No. PCT US2023 015228, IPRP mailed Sep. 26, 2024", 11 pages.
"U.S. Appl. No. 17/957,207, Response filed Oct. 14, 2024 to Final Office Action mailed Jun. 12, 2024", 14 pages.
"U.S. Appl. No. 17/473,178, Response filed Oct. 14, 2024 to Final Office Action mailed Jun. 14, 2024", 14 pages.
"U.S. Appl. No. 18/093,636, Response filed Oct. 14, 2024 to Non Final Office Action mailed Jun. 14, 2024", 14 pages.
"U.S. Appl. No. 17/473,178, Examiner Interview Summary mailed Oct. 16, 2024", 3 pages.
"U.S. Appl. No. 17/826,054, Final Office Action mailed Oct. 18, 2024", 14 pages.
U.S. Appl. No. 18/426,042, filed Jan. 29, 2024, Devices and Methods For Performing Shear-Assisted Extrusion and Extrusion Processes.
"U.S. Appl. No. 17/957,207, Response filed Nov. 8, 2024 to Advisory Action mailed Oct. 31, 2024 and Final Office Action mailed Jun. 12, 2024", 16 pages.
"U.S. Appl. No. 17/957,207, Advisory Action mailed Oct. 31, 2024", 3 pages.
"U.S. Appl. No. 17/473,178, Advisory Action mailed Oct. 31, 2024", 3 pages.
"U.S. Appl. No. 17/473,178, Response filed Nov. 8, 2024 to Advisory Action mailed Oct. 31, 2024 and Final Office Action Jun. 14, 2024", 14 pages.
"Canadian Application Serial No. 3,105,375, Examiners Rule 86(2) Report mailed Nov. 6, 2024", 9 pages.
"U.S. Appl. No. 17/874,140, Final Office Action mailed Nov. 15, 2024", 11 pages.
"U.S. Appl. No. 17/035,597, Response filed Feb. 6, 2025 to Non Final Office Action mailed Sep. 6, 2024", 8 pgs.
"U.S. Appl. No. 17/826,054, Response filed Jan. 6, 2025 to Final Office Action mailed Oct. 18, 2024", 9 pgs.
"U.S. Appl. No. 17/985,611, Final Office Action mailed Dec. 5, 2024", 15 pgs.
"U.S. Appl. No. 18/093,636, Final Office Action mailed Jan. 13, 2025", 12 pgs.
"European Application Serial No. 20869757.3, Response filed Jan. 3, 2025 to Communication Pursuant to Article 94(3) EPC mailed Sep. 4, 2024", 10 pgs.
"JP-2002361320-A Translation provided by FIT database", Retrieved from Patent Center, (Year: 2025), 8 pages.
X, Li, et al., "CN-105925846-B translation provided by FIT database (Year: 2024)", (Feb. 23, 2018), 12 pgs.

* cited by examiner

- INTERMETALLICS OVSERVED:
  - $Mg_2Si$
- IMPURITY PPTS OBSERVED:
  - Mn & Al — RICH
  - AL & Zn — RICH
- GRAIN SIZE ~ 1 mm
- RANDOM BASAL TEXTURE

FUNCTIONALLY GRADED COATINGS AND CLADDINGS

PRIORITY

This application is a continuation of U.S. patent application Ser. No. 16/916,548 filed Jun. 30, 2020, which is a continuation of U.S. patent application Ser. No. 15/898,515 filed Feb. 17, 2018, now U.S. Pat. No. 10,695,811 issued Jun. 30, 2020, which claims priority to and the benefit of U.S. Provisional Patent Application No. 62/460,227 filed Feb. 17, 2017, and which is a continuation-in-part of U.S. patent application Ser. No. 15/351,201 filed Nov. 14, 2016, now U.S. Pat. No. 10,189,063 issued Jan. 29, 2019, which claims priority to and the benefit of U.S. Provisional Patent Application No. 62/313,500 filed Mar. 25, 2016, and which is a continuation-in-part of U.S. patent application Ser. No. 14/222,468 filed Mar. 21, 2014, now abandoned, which claims priority to and the benefit of U.S. Provisional Patent Application No. 61/804,560 filed Mar. 22, 2013, the entirety of each of which is hereby incorporated by reference.

STATEMENT AS TO RIGHTS TO INVENTIONS MADE UNDER FEDERALLY-SPONSORED RESEARCH AND DEVELOPMENT

This invention was made with Government support under Contract DE-AC0576RL01830 awarded by the U.S. Department of Energy. The Government has certain rights in the invention.

BACKGROUND OF THE INVENTION

Several techniques are currently employed to clad materials. These include techniques such as extrusion, rolling, electroplating, weld forming, explosive bonding and the like. Among these techniques extrusion and rolling are sensitive to variable flow stresses of the two materials and require strenuous optimization of processing parameters. Typical defects or challenges to be addressed in using these techniques include non-uniform thicknesses, porous interfaces, lack of metallurgical bonding, etc. and it especially becomes challenging when working with anisotropic hexagonal close packed (HCP) material such as magnesium, titanium or zirconium. The other aforementioned techniques are slow batch processes and unable to control the graded interface or create the desired texture in the final component.

Magnesium is a desirable material for lightweight structures is limited by its corrosion resistance, but cladding it with aluminum or similar material will significantly improve the corrosion resistance and its ability to join with other material systems. Several technical challenges arise when forming such structure such as controlling the texture of the magnesium such that the asymmetry in mechanical properties under compression and tension is eliminated, the preferred grain size of the magnesium is less than 5 micron with an aluminum cladding bonded to the magnesium and the same time forms a graded interface to minimize the corrosion rate in the system. The present disclosure provides a methodology that allows for making structures with specified cladding as well as making structures that have desired shapes and microstructural and mechanical characteristics that existing methodologies struggle to provide.

To meet these needs a process has been developed wherein functionally graded claddings and coatings are produced in a single step with tailored physical properties (such as microstructure, mechanical, electrical, thermal, etc.) and at the same time provide high corrosion resistance. Typically clad materials are preferred material systems for engineering applications, as one metal/alloy often does not satisfy the required application conditions. The major advantage of cladding is the ability to tailor properties such that the surface has a different chemical composition and properties relative to the core. For example aluminum clad copper wires provide excellent conductivity with improved corrosion life. Clad materials also offer minimal use of expensive materials, such as high temperature materials, and at the same time retain the desired physical properties such as thermal conductivity.

Over the past several years researchers at the Pacific Northwest National Laboratory have developed a novel Shear Assisted Processing and Extrusion (ShAPE™) technique which uses a rotating ram as opposed to the axially fed ram used in the conventional extrusion process. As described in the previously cited and incorporated references, in some embodiments the ram face contains spiral scroll features which when brought into contact with a solid billet and a forging load is applied, significant heating occurs due to friction, thus softening the underlying billet material. The combined action of the forging load together with the rotating action of the ram face, force the underlying material to flow plastically. The scroll features on the ram face help in the material flow and help in controlling the texture.

We have successfully demonstrated the scalability of this process, and we were able to alter and control the texture, grain size and also uniformly disperse the secondary particles by changing a few process parameters and at loads/pressure several orders or magnitude lower than conventional extrusion. We have now expanded applications of this tool and process to generate cladded materials by extrusion and to control various features of structures formed by this technique.

This provides significant promise over several of the prior art techniques which are typically employed to clad materials such as extrusion, rolling, electroplating, weld forming, explosive bonding, etc. Extrusion and rolling are sensitive to variable flow stresses of the two materials and require strenuous optimization of processing parameters. Typical defects or challenges to address using these techniques are non-uniform thickness, porous interface, lack of metallurgical bond, etc. and it especially becomes challenging when working with anisotropic HCP material such as magnesium, titanium or zirconium. Typically the aforementioned techniques are performed in a slow batch processes and are unable to control the graded interface or create the desired texture in the final component. Conventional linear extrusions typically have virtually constant crystallographic texture across the wall thickness.

Developing a method for forming extrusions while simultaneously varying the texture across the wall thickness could lead to improved bulk material properties. Such improvement could include but are not limited to increased strength, reduced susceptibility to corrosion and brittleness, Mechanical property improvements through breakdown and dispersion deleterious second phase particles, corrosion resistance though elimination of galvanically unfavorable second phases and precipitates, and extrusion of brittle intermetallic materials not possible by conventional means among them.

The purpose of the foregoing abstract is to enable the United States Patent and Trademark Office and the public generally, especially the scientists, engineers, and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Various advantages and novel features of the present invention are described herein and will become further readily apparent to those skilled in this art from the following detailed description. In the preceding and following descriptions I have shown and described only the preferred embodiment of the invention, by way of illustration of the best mode contemplated for carrying out the invention. As will be realized, the invention is capable of modification in various respects without departing from the invention. Accordingly, the drawings and description of the preferred embodiment set forth hereafter are to be regarded as illustrative in nature, and not as restrictive.

SUMMARY

The advantages of the present disclosure lie in the application of a shear assisted extrusion process for producing cladded materials wherein a cladding material and a material to be cladded are placed in sequence with the cladded material positioned to contact a rotating scroll face first and the material to be cladded second. The two materials are fed through a shear assisted extrusion device at a preselected feed rate and impacted by a rotating scroll face to generate a cladded extrusion product.

In one example the cladding material is aluminum, and the material to be clad is magnesium or a magnesium alloy. In some instances the preselected feed rate is 0.05-1.0 inches per minute, in others the rotating scroll face rotates at a rate of 10-1000 rotations per minute. The rotating scroll face can have at least 2 starts. In some embodiments the axial extrusion force is less than 50 MPa and the temperature of the billet (aluminum, magnesium or both) is less than 100° C. In various applications feed rates are varied to include a rate of less than 0.2 inches (0.51 cm) per minute and the rotational shearing force is generated from spinning the die or the billet at a rate between 100 rpm to 500 rpm.

In another embodiment, a process for creating an aluminum cladded magnesium product comprising the steps of placing a thin sheet of aluminum having a hole defined therein on center of a magnesium billet in a shear assisted extrusion device, impacting the billet with a rotating scroll face rotating at rate of (10-1000 RPM) and a feed rate of 0.05-1.0 inches per minute to extrude an aluminum cladded magnesium material. This extrusion process can include the steps of: simultaneously applying a rotational shearing force and an axial extrusion force to a billet while contacting one end of the billet with a scroll face configured to engage and move plasticized billet material toward an orifice whereby the plastically deformed billet material flows substantially perpendicularly from an outer edge of the billet through the orifice forming an extrusion product with microstructure grains about one-half the size of the grains in the billet prior to extrusion. In some variations the extrusion of the plasticized billet material is performed at a temperature less than 100° C. In other applications the axial extrusion force is at or below 100 MPa.

The resulting materials developed by such a process provide materials with mechanical property improvements through breakdown and dispersion deleterious second phase particles enabled by such a process. This includes corrosion resistance though elimination of galvanically unfavorable second phases and precipitates. The extrusion of brittle intermetallic materials not possible by conventional means and other advantages not available in the prior art.

DETAILED DESCRIPTION OF THE INVENTION

The following description including the attached pages provide various examples of the present invention. It will be clear from this description of the invention that the invention is not limited to these illustrated embodiments but that the invention also includes a variety of modifications and embodiments thereto. Therefore the present description should be seen as illustrative and not limiting. While the invention is susceptible to various modifications and alternative constructions, it should be understood, that there is no intention to limit the invention to the specific form disclosed, but, on the contrary, the invention is to cover all modifications, alternative constructions, and equivalents falling within the spirit and scope of the invention as defined in the claims.

Various methods and techniques are described wherein application and manipulation and modification of the ShAPE™ technique and device as shown for example in demonstrated the ability to control microstructure such as crystallographic texture through the cross sectional thickness, while also providing the ability to perform various other tasks such as cladding aluminum to magnesium.

Figure 1:
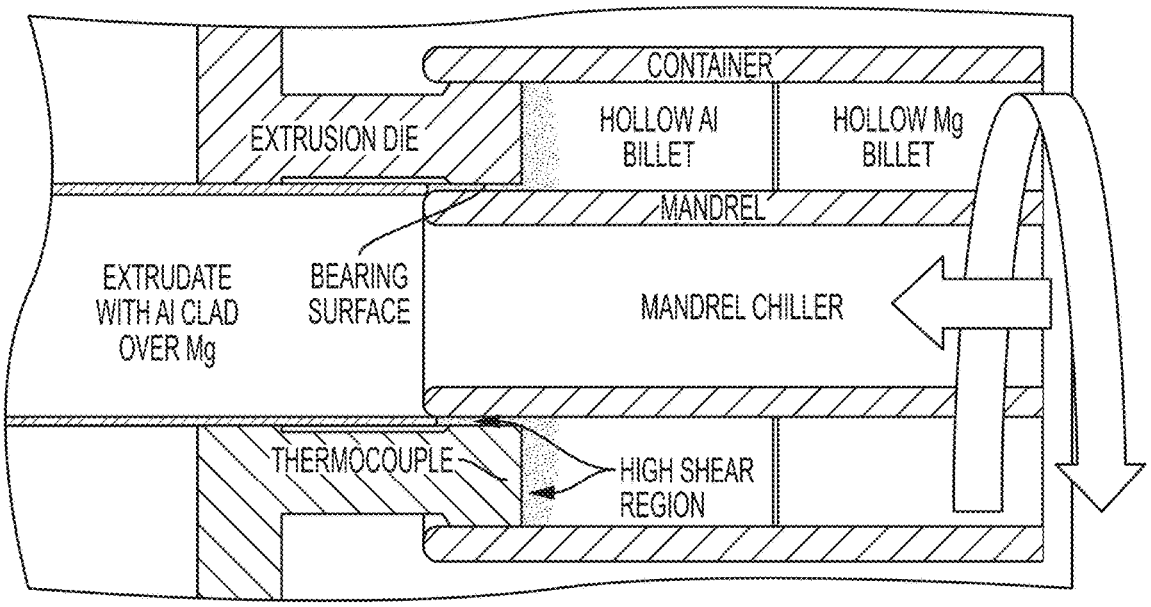
FIG. 1, shows the placement of a billet of aluminum with hole on center in front of a magnesium billet also having a hole in the center in an arrangement that creates an aluminum cladded magnesium extrusion product.

In one embodiment, such as the arrangement shown in FIG. 1, where in the typical mandrel is not present, a billet of aluminum with hole on center is placed in front of a magnesium billet also having a hole in the center, and processed within an extrusion die using a novel Shear Assisted Processing and Extrusion (ShAPE™) technique which uses a rotating ram. When brought into contact with the billet and a forging load is applied, significant heating at a high shear region near the contact between the die and the billet, thus softening the underlying billet material. The combined action of the forging load together with the rotating action of the ram face, force the underlying material to flow plastically. The scroll features on the extrusion die help in the material flow and help in controlling the texture.

Figures 3A, 3B, 3C:
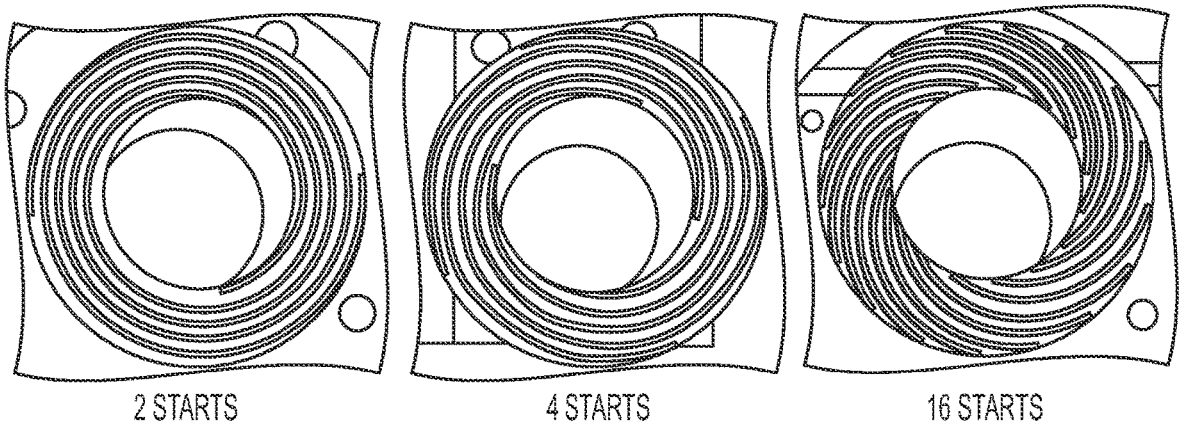
FIGS. 3A-3C show illustrative examples of different scroll geometries on the face on various extrusion dies.

It has been shown that the geometry of the scroll face, using 2, 4 and 16-start tools shown in FIGS. 3A-3B, and accompanying process parameters directly affect texture through the tube wall. With these scrolled patterns, the billet is rotated in the counterclockwise direction to gather material into the extrusion orifice as the billet is pressed against the die face.

In this arrangement where the aluminum billet and the magnesium billets are together within the structure the impact of the aluminum billet with the scroll face at relatively slow rate (150 RPM) and slow feed rate 0.3-0.15 inches per minute at room temperature, created an aluminum cladded magnesium extrusion product in tubular, wire, or rod form. In addition to this arrangement other arrangements have been shown to produce cladded materials such as rods and wire. In one particular instance this process was used to form actual extrusion components including ZK60 tubing having an outer diameter of 2.0" and wall thickness of 60 and 120 mils.

Figure 2:
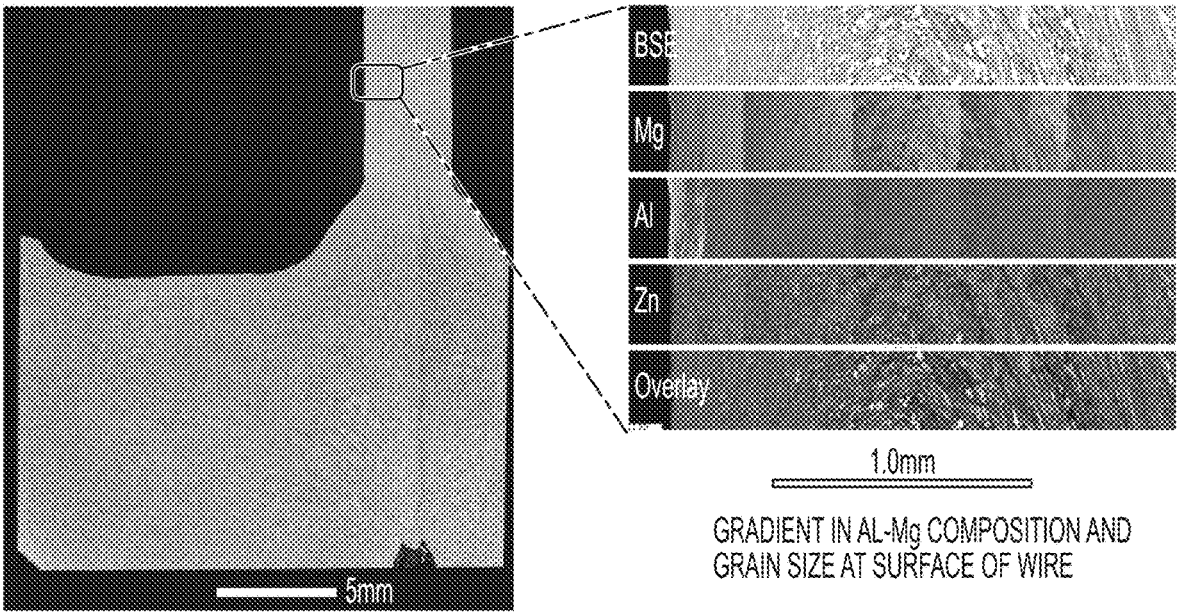
FIG. 2 shows the cross section of a magnesium alloy wire/rod where the outer surface is clad with a high fraction of aluminum with highly refined grain size.

FIG. 2 shows the cross section of a magnesium alloy wire/rod where the outer surface is clad with a high fraction of aluminum with highly refined grain size. Not only does the aluminum cladding provide a corrosion barrier for the magnesium, the highly refined microstructure within the aluminum clad is also know to reduce corrosion rate. This advantages are particularly seen with claddings that are otherwise difficult to form, examples include but are not limited to applications such as rivets and fastener applications, wires for electrical applications (inner aluminum and outer copper or vice versa or steel based), nuclear fuel, piping/conduits.

In other applications, methodologies using the ShAPE™ design have also been developed to allow for through-wall texture control, extrusion of additional materials that were previously considered not possible for extrusion by conventional extrusion processes (such as AZS 312/317 magnesium alloys), increasing the strength, ductility, corrosion resistance and energy absorption in various materials, significant grain refinement and basal texture alignment, creation of extruded materials with reduced potential for microgalvanic corrosion, breakdown of $Mg_2Si$ intermetallics to nanoscale, elimination of Al—Zn precipitates by dissolution into solid solution, elimination of $Mg_{17}Al_{12}$ (β phase), uniform dispersion of second phases, improved ductility, and increased compressive yield stress. The application of this process is not limited to these alloys but unconventional systems like high entropy alloys have also been processed to create a single phase alloy and eliminated the dire homogenization step.

As will be described below in more detail, in addition to modifying various parameters such as feed rate, heat, pressure and spin rates of the process, various mechanical elements of the tool assist to achieve various desired results. For example, scroll patterns on the face of extrusion dies (in the ShAPE™ process) can be used to affect/control crystallographic texture through the wall thickness of extruded tubing. This can be used to advantageously alter bulk materials properties such as ductility and strength. These properties can in turn be tailored for specific engineering applications such crush, pressure or bending.

The die design and process parameters can offer unprecedented control over the microstructure of materials. An illustrative example is the use of different scroll geometry as shown in FIGS. 3A-3C for ZK60 magnesium tubing. In one set of experiments, the 2-start scroll gave a constant texture through the wall thickness, and then varying process parameters led to changes in texture. This system also enhanced the microstructure and eventually mechanical properties of the system. The basal texture of the material was not parallel to the extrusion axis, which is typical of traditional extrusion processes. Utilizing differing scroll patterns (4 starts and 16 starts) has been shown to vary texture and grain size across the thickness of the tube wall with process parameters held constant. This is yet another example of the ShAPE™ process enabling material properties that are not possible with conventional linear extrusion.

In a first set of examples, the process parameters were as follows: material: Magnesium alloy ZK60, rotational speed 250 revolutions per minute (range can be 10-1000 rpm), extrusion rate: 0.15 inches per minute (range can be 0.05 to 1.0 ipm), die face temperature: 450 degrees Celsius (range can be 200 to 500 degrees Celsius). Under these conditions tubes with 60 mil wall thickness were extruded using 2, 4 and 16 start scrolls. One tube with 120 mil wall thickness was extruded using a 4 start scroll. This makes for a total of four tubes for which data has been collected supporting this invention.

Figure 4:
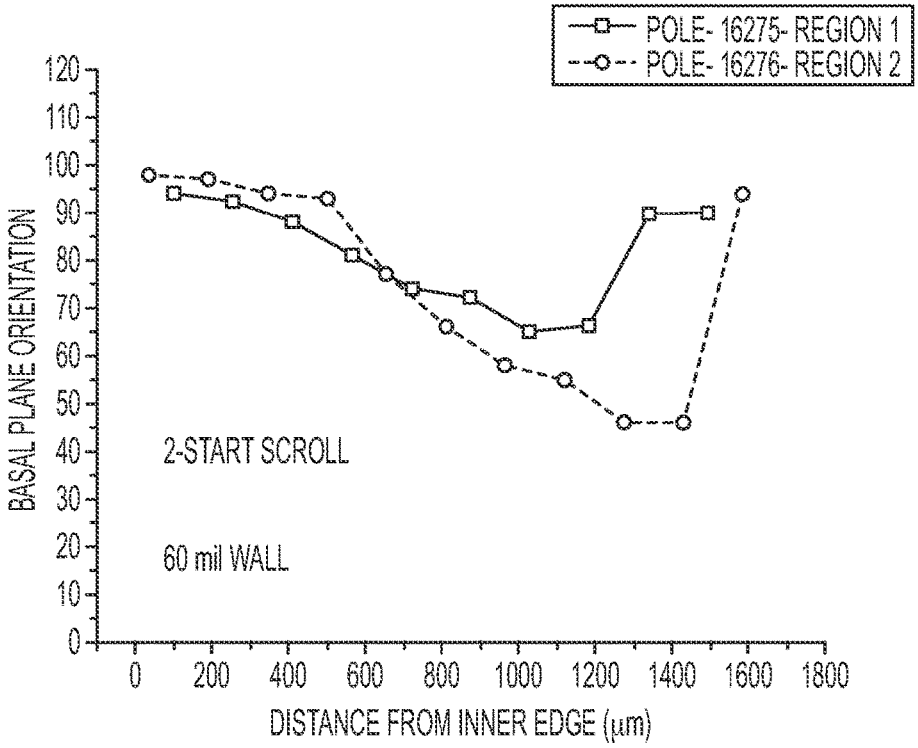
FIG. 4 shows an example of the (0001) basal texture at two cross section locations for the 60 mil thick tube made with a 4 start scroll.

All four tubes were cross sectioned through at least two locations along the length of the tube to ensure that potential variations in texture along the tube length were also captured. FIG. 4 shows an example of the (0001) basal texture at two cross section locations for the 60 mil thick tube made with a 4 start scroll. A full 60 degree change in texture is observed between the inner and outer surface of the tube wall thickness. The same data was also acquired for 60 mil thick tubes formed with 2 and 16 start scrolls and a 120 mil thick tube made using a 4 start scroll.

Figure 5A:
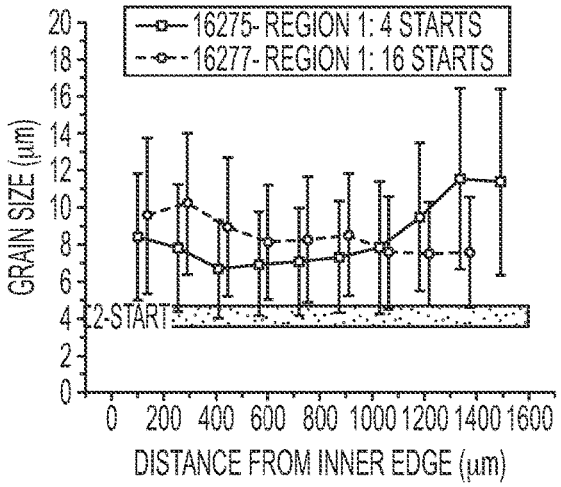
FIGS. 5A and 5B summarize the data for grain size and texture orientation for 60 mil thick tube walls made with 2, 4 and 16 start scrolls.
Figure 5B:
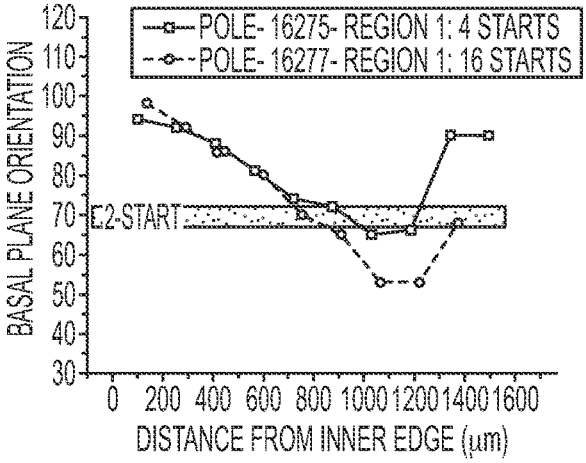

FIGS. 5A and 5B summarize the data for grain size and texture orientation for 60 mil thick tube walls made with 2, 4 and 16 start scrolls. The horizontal blue bar for 2 start scrolls indicates that the grain size and texture are essentially constant across the wall thickness. Grain size does not appear to change as a function of the scroll geometries and process conditions explored. However, texture is seen to vary substantially based on the scroll geometry. With a 2 start scroll, texture was not seen to vary across the wall thickness, but texture was seen to vary dramatically with the 4 and 16 start scrolls.

Figure 6A:
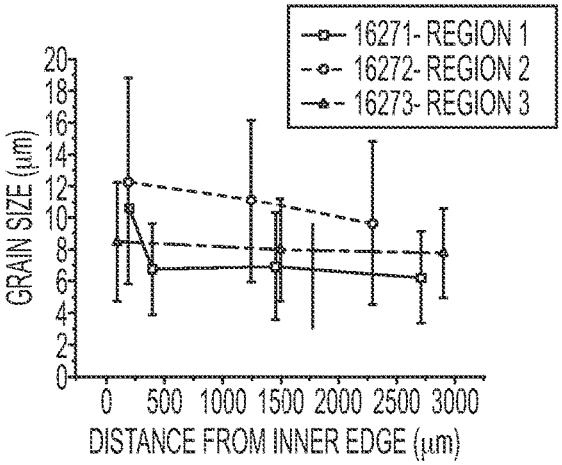
FIGS. 6A and 6B show for a 120 mil thickness tube made with a 4 start scroll.
Figure 6B:
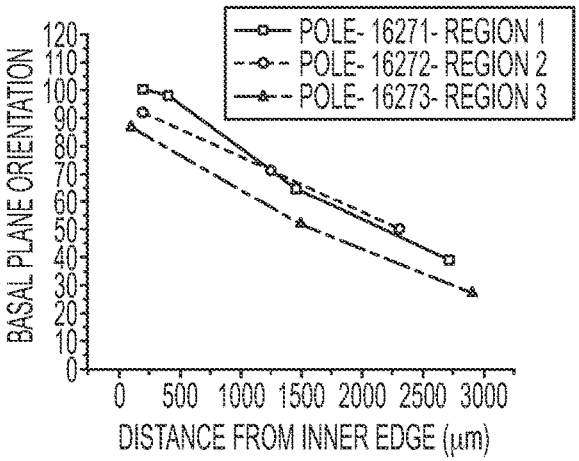
Figure 7A:
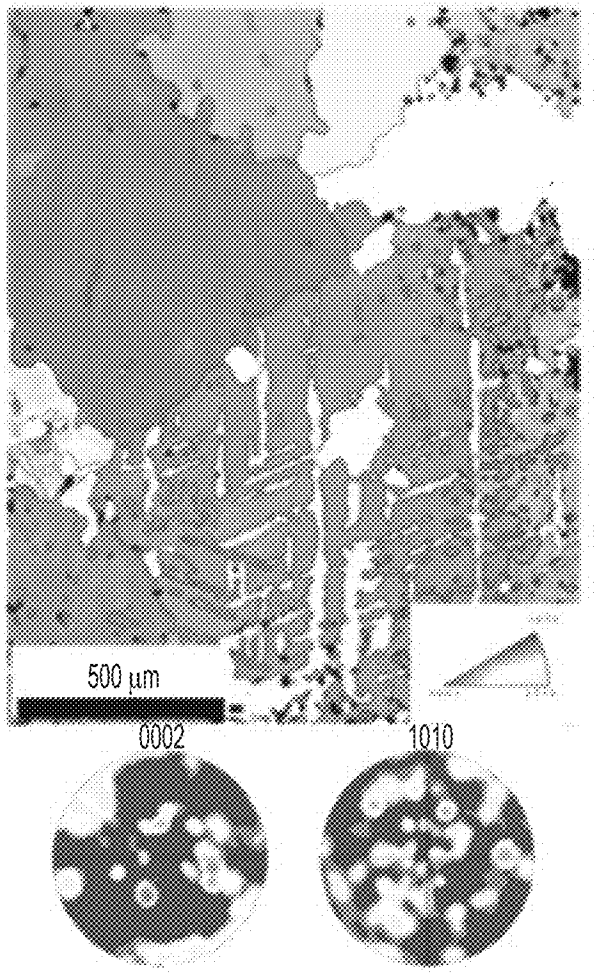
FIGS. 7A-7B show the microstructure of AZS312 in the as-cast materials
Figure 7A:
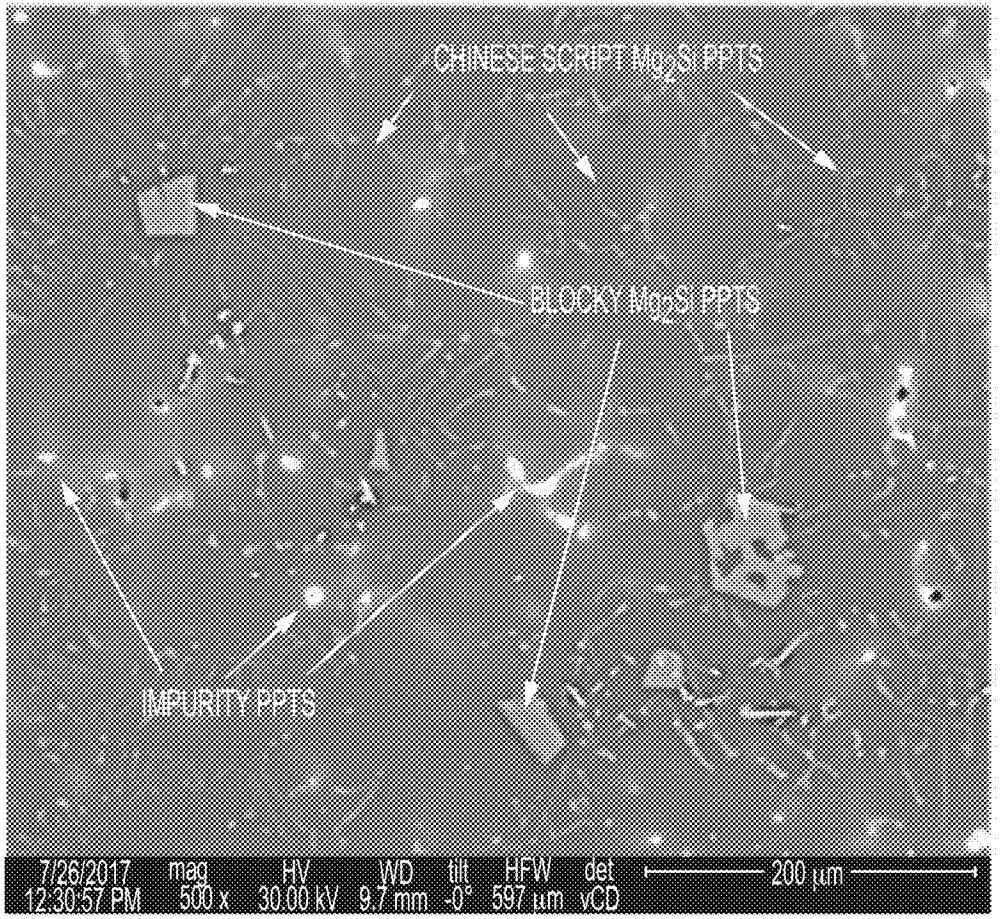
Figure 7B:
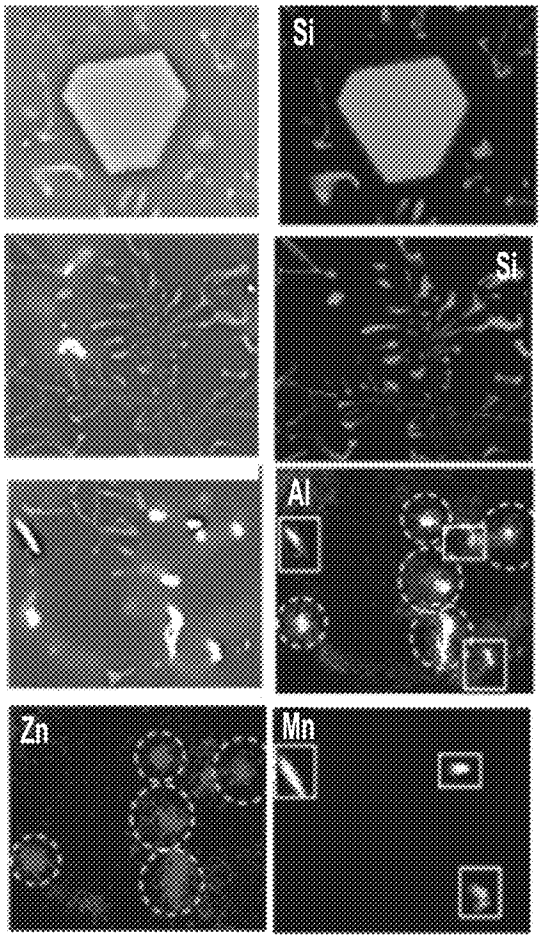
Figure 7C:
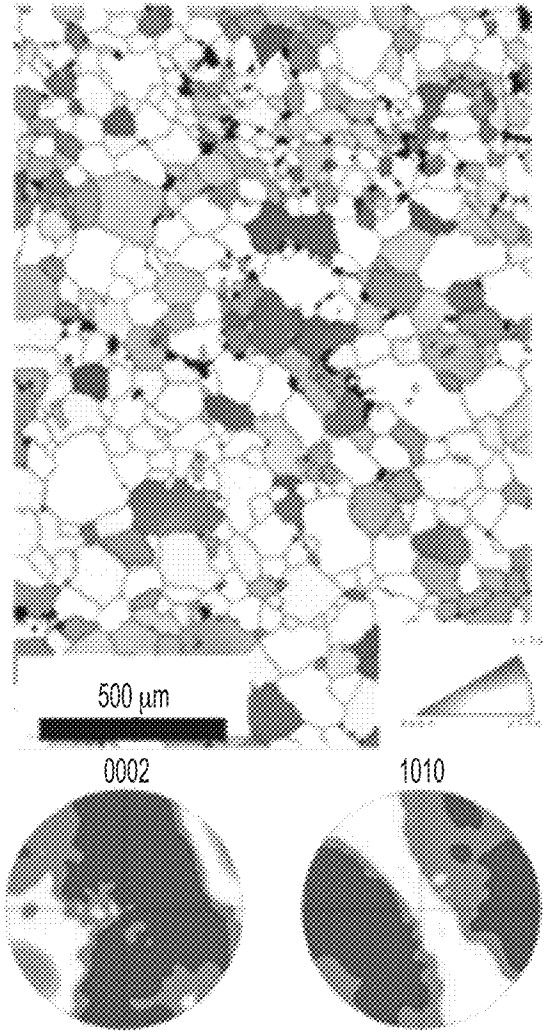
FIGS. 7C-7D show the microstructure of AZS213 in the extruded materials formed by the claimed process.
Figure 7C:
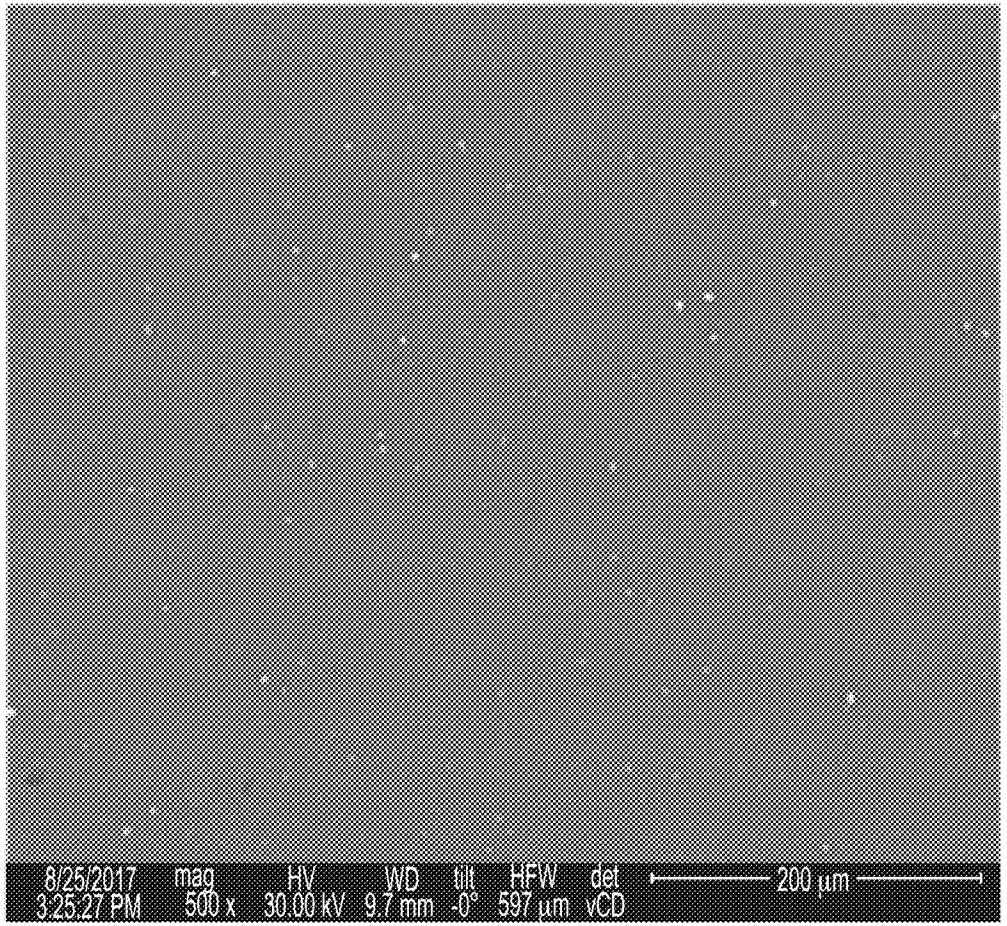
Figure 7D:
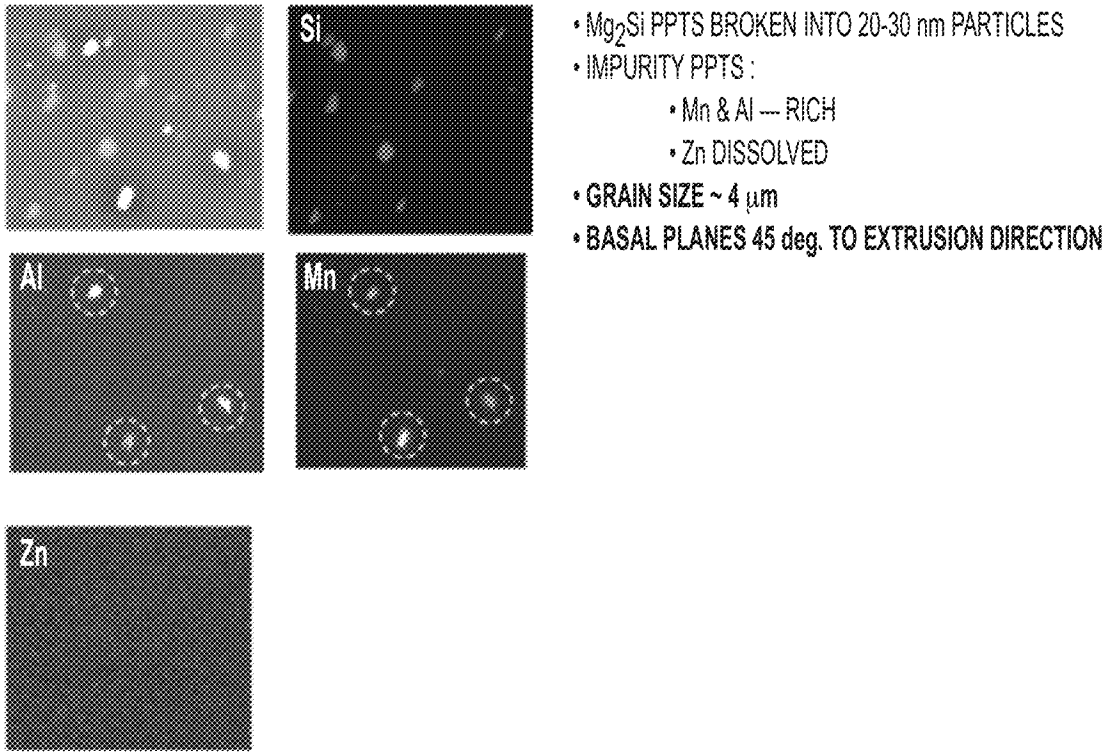

FIGS. 6A and 6B show for a 120 mil thickness tube made with a 4 start scroll. Again the grain size is relatively constant through the wall thick but the texture again varies dramatically through the wall thickness changing by a full 90 degrees. The ability to control and tailor texture through the thickness of a thin-walled tube is a novel discovery enabled by the ShAPE™ process. From detailed microstructural investigations we have determined the texture is developed as the material is gathered toward the extrusion orifice and obtains its final orientation as it enters the orifice. The combination of scroll geometry and process conditions are used to tailor the basal texture orientation as it enters the extrusion orifice, including across the wall thickness, which in turns sets the texture for the entire length of the extrusion.

In addition to being able to providing a process for cladding, and obtaining a desired through wall thickness. The ShAPE™ technology platform can be used to obtain structures from various materials that have not been demonstrated in other prior art configurations.

For example, Mg alloys containing Si are attractive for automotive, aerospace and high temperature applications. The maximum solubility of Si in Mg is less than 0.003 at % and the Si atoms react to form $Mg_2Si$ precipitates, which results in forming an alloy that has high melting point, low density, low coefficient of thermal expansion and increases the elastic modulus. It is also known that the $Mg_2Si$ precipitates have the same galvanic potential as that of the mg alloy matrix which results in minimization or elimination of microgalvanic corrosion making for a more corrosion resistant alloy. However, casting these alloys results in very low ductility and strength due to the formation of large $Mg_2Si$ precipitates and Chinese script brittle eutectic phase and thus cannot be easily extruded. In order to overcome this challenge several others have tried hot extrusion, rapid solidification and extrusion and mechanical alloying. All these techniques help refine the microstructure and the precipitate morphology but involve additional steps which increases the cost of the processing and does not entirely solve the issues associated with extruding such a brittle material. Even with these approaches, the extruded products also have brittle properties.

Wire and rod of brittle magnesium alloys AZS312 and AZS317 has been extruded with 2.5 mm and 5.0 mm diameters using the ShAPE™ process. Process parameters range from 0.05 to 1.0 for feed rate, 10 to 1000 for rpm rotational speed with extrusion ratios demonstrated up to 160:1 and anticipated as going as high as 200:1. Process parameters will vary depending on the material and desired extrudate dimension and the parameter values mentioned are indicative of the material/geometry investigated and are not restrictive to the process of extruding brittle materials in general. Table 1 shows mechanical test data for AZS312 and AZS317 extruded by ShAPE™ into 5.0 mm rod. The table also shows data for conventionally extruded AZ31 as a benchmark for comparison.

TABLE 1

| | Tensile | | | Compression | | |
|---|---|---|---|---|---|---|
| Alloy | Yield Strength (MPa) | Ultimate Tensile Strength (MPa) | Elongation (%) | Yield Strength (MPa) | Compressive Strength (MPa) | CYS/TYS Ratio |
| AZ31 | 200 | 255 | 12 | 97 | NA | 0.48 |
| AZ312 | 170 | 252 | 17 | 160 | 403 | 0.94 |
| AZS317 | 145 | 200 | 7 | 155 | 281 | 1.06 |

The AZS alloys compare similarly with AZ31 in terms of ultimate strength but show a marked improvement compressive yield strength form 97 MPa for AZ31 to 160 MPa and 155 MPa for AZS312 and AZS317 respectively. The higher compressive strength for the AZS alloys also leads to a dramatic improvement in the ratio of compressive yield strength to tensile yield strength (CYS/TYS) with 0.48 for AZ31 and 0.94 and 1.06 for AZS3112 and AZS317 respectively. This is important because the optimum value for CYS/TYS is 1.0 for energy absorption applications. In addition, the elongation at failure improves from 12% for AZ31 to 17% for AZS312. In the case of AZS alloys, ShAPE™ not only enables the extrusion of brittle materials directly from castings, but the unique shearing conditions intrinsic to ShAPE™ also enable novel microstructures which lead to the improved properties shown in Table 1.

For example FIGS. 7A-7D show the microstructure of AZS312 in the as-cast materials and after extrusion. Comparing microstructure before and after extrusion, the data in FIGS. 7A-7D shows grain refinement from ~1 mm to ~4 microns, basal texture alignment from random to 45 degrees to the extrusion axis, break down of $Mg_2Si$ second phase particles from mm to nm scale, uniform dispersion of $Mg_2Si$ second phase, and dissolution of Al into the matrix which result in the elimination of the Al—Zn impurity. In addition, the brittle $Mgr_{17}Al_{12}$ intermetallic present in AZ31 is not present in the AZS castings. From a corrosion standpoint, AZS312/317 alloys also offer improved corrosion resistance compared to AZ31 as shown in Table 2 where the galvanic corrosion potentials are listed for the constituents within each material.

TABLE 2

| AZ31 | | AZS312 | |
|---|---|---|---|
| Phase | Corrosion Potential | Phase | Corrosion Potential |
| Mg(matrix) | −1.65 | Mg(matrix) | −1.65 |
| $Mg_2Si$ | −1.65 | $Mg_2Si$ | −1.65 (broken down into nanoscale particles) |
| $Al_6Mn$ | −1.52 | $Al_6Mn$ | −1.52 |
| $Al_4Mn$ | −1.45 | $Al_4Mn$ | −1.45 |
| Al—Zn | −1.42(approx.) | Al—Zn | Does not exist in extrusion, Zn absorbed into particles |
| $Mg_{17}Al_{12}$ (β) | −1.20 | $Mg_{17}Al_{12}$ (β) | Does not exist in casting-Mg combines with Si instead |

First, the brittle $Mgr_{17}Al_{12}$ intermetallic present in AZ31 is not present in the AZS castings because Mg combines favorably with Si instead of Al during the casting process. As such, second phase with the lowest corrosion potential is eliminated which reduces corrosion rate. Second, Al from the Al—Zn impurity dissolves into the Mg matrix during ShAPE™ processing which further reduces the overall corrosion potential. Third, the fracturing of mm scale $Mg_2Si$ particles to the nm scale is known to reduce microgalvanic corrosion.

While various preferred embodiments of the invention are shown and described, it is to be distinctly understood that this invention is not limited thereto but may be variously embodied to practice within the scope of the following claims. From the foregoing description, it will be apparent that various changes may be made without departing from the spirit and scope of the invention as defined by the following claims.

What is claimed is:

1. An extrusion process comprising:

simultaneously providing a rotational shearing force and an axial extrusion force between a spiral-scroll-faced extrusion die and one end of a billet positioned within a rotating container and in contact with a scroll face of the spiral-scroll-faced extrusion die, the scroll face comprising spiral scroll features to plasticize the one end of the billet;

wherein the spiral scroll features of the spiral-scroll-faced extrusion die are configured to convey plasticized billet material from an outer edge of the scroll face of the spiral-scroll-faced extrusion die through an orifice within the spiral scroll features of the spiral-scroll-faced extrusion die as the spiral-scroll-faced extrusion die is rotated to form an extrusion product.

2. The process of claim 1 wherein extrusion of the plasticized billet material is performed at a temperature less than 100° C.

3. The process of claim 1 wherein the axial extrusion force is at or below 100 MPa.

4. The process of claim 1 wherein the billet comprises the one end of the billet and a remainder of the billet, the remainder of the billet being at or below ambient temperature during the extrusion process.

5. The process of claim 1 wherein the billet is heated at the one end when providing the rotational shearing force and the axial extrusion force between the one end of the billet and the scroll face of the spiral-scroll faced extrusion die.

6. The process of claim 1 wherein the spiral scroll features of the spiral-scroll-faced extrusion die defines between 2 and 16 spiral starts.

7. The process of claim 1 wherein the orifice of the spiral-scroll-faced extrusion die is configured to receive a mandrel, the plasticized billet material being conveyed between an exterior of the mandrel and an interior of the orifice.

8. The process of claim 7 wherein the billet is configured with an opening configured to receive the mandrel.

9. The process of claim 8 wherein the mandrel is a chilled mandrel.

10. The process of claim 8 wherein the billet comprises at least two different materials.

11. The process of claim 1 wherein the billet is not heated prior to the extrusion.

12. The process of claim 1 wherein a size of microstructure grains of the extrusion product are less than a size of microstructure grains of the billet.

13. The process of claim 12 wherein the size of the microstructure grains of the extrusion product are approximately one-half the size of the microstructure grains of the billet prior to providing the rotational shearing force and the axial extrusion force.

14. A device for performing shear-assisted extrusion, the device comprising:

a die tool defining a scroll face, the scroll face comprising spiral scroll features and an orifice within the spiral scroll features;

a rotating container configured to hold and position a billet within the rotating container; and at least one actuator to establish a rotational shearing force and an axial extrusion force between the die tool and an end of the billet positioned in the rotating container and in contact with the scroll face by establishing rotation of the rotating container relative to the die tool;

wherein the spiral scroll features are configured to plasticize the end of the billet as the die tool is rotated to allow the die tool to extrude plasticized billet material through the orifice to form an extrusion product.

15. The device of claim 14, wherein the spiral scroll features are configured to convey the plasticized end of the billet from an outer edge of the scroll face of the die tool toward the orifice within the spiral scroll features of the die tool as the die tool is rotated.

16. The device of claim 15, wherein the die tool is configured to move plasticized billet material through the orifice surrounded by the spiral scroll features.

17. An extrusion process comprising:

simultaneously providing a rotational shearing force and an axial extrusion force at an interface between a spiral-scroll-faced extrusion die and one end of a billet positioned within a rotating container and in contact with a scroll face of the spiral-scroll-faced extrusion die, the scroll face comprising spiral scroll features to plasticize the one end of the billet;

wherein the spiral scroll features of the spiral-scroll-faced extrusion die are configured to engage and move plasticized billet material toward an orifice at which the spiral scroll features terminate, from an outer edge of the scroll face of the spiral-scroll-faced extrusion die through the orifice as the spiral-scroll-faced extrusion die is rotated to form an extrusion product; and wherein the billet is at or below ambient temperature prior to extrusion.

18. The extrusion process of claim 17 wherein a grain size of the extrusion product is relatively constant throughout a wall thickness of the extrusion product.

19. The extrusion process of claim 18 wherein a grain refinement of the extrusion product is from approximately 1 mm to approximately 4 microns.

20. The extrusion process of claim 18 wherein a texture throughout the wall thickness of the extrusion product is variable.

* * * * *